United States Patent [19]

Brauer et al.

[11] Patent Number: 4,512,173

[45] Date of Patent: Apr. 23, 1985

[54] TUBE RELEASE ROLLING MILLS

[75] Inventors: Hans Brauer, Leichlingen; Hans-Dieter Gerhards, Monheim, both of Fed. Rep. of Germany

[73] Assignee: Kocks Technik GmbH & Co., Hilden, Fed. Rep. of Germany

[21] Appl. No.: 512,472

[22] Filed: Jul. 11, 1983

[30] Foreign Application Priority Data

Jul. 23, 1982 [DE] Fed. Rep. of Germany ..... 3227532

[51] Int. Cl.[3] ..... B21B 19/08

[52] U.S. Cl. ..... 72/98; 72/99

[58] Field of Search ..... 72/98, 99, 100, 68, 72/95, 96, 97

[56] References Cited

U.S. PATENT DOCUMENTS 2,411,395 11/1946 Sutton ..... 72/98

3,187,536 6/1965 Zolton ..... 72/99

FOREIGN PATENT DOCUMENTS 1366681 9/1974 United Kingdom ..... 72/98

*Primary Examiner*—Lowell A. Larson

*Assistant Examiner*—Jorji M. Griffin

*Attorney, Agent, or Firm*—Buell, Ziesenheim, Beck & Alstadt

[57] ABSTRACT

The invention concerns a tube release roll mill with four or more driven rolls, which in pairs form a pass opening. The diagonally positioned identically constructed rolls have an enlarged working surface width. A certain roll pair spacing is also provided, as well as an enlarged angle of attack of the rolls, which together result in the wall thickness of the tube bloom being more uniform, the development of fewer surface defects, and a quieter operation of the roll mill.

18 Claims, 5 Drawing Figures

TUBE RELEASE ROLLING MILLS

This invention relates to tube release rolling mills and more particularly to tube release rolling mills with four or more drive rolls that form pass openings in pairs and whose roll axes extend at an adjustable angle of attack diagonally to the longitudinal direction of the rolled goods, in which case the roll axes of each roll pair run diagonally in different directions in an intersecting manner.

In familiar tube release roll mills of this type the two rolls of each roll pair are arranged vertically one above the other, where the upper and lower rolls are designed differently. The upper rolls at least, and frequently the lower rolls also, have a working surface width in the familiar constructions that is smaller than the advance distance per revolution of the tube bloom to be rolled. The spacings of the roll pairs in the longitudinal direction of the rolled goods are fixed in line with structural viewpoints, e.g., as a function of the dimensions of the rolls and the bearing housings holding them, and as a function of the diameters of the guide sleeves in the roll mill stand, in which the guide pilots are supported, on whose front side the bearing housings for the rolls are located. In general, one strives for the smallest possible spacing of the roll pair in the determination.

These familiar tube release roll mills have the disadvantage that wall thickness differences of 10–15% occur at various sites closely following each other on the tube bloom. These wall thickness differences on relatively short longitudinal sections cannot be completely eliminated during the subsequent processing to a finished tube; therefore, they are still detectable in the finished tube. These wall thickness differences arise from the fact that the somewhat hyperbolically designed rolls in the region of the roll base, i.e., at the site of the roll working surface, which comes closest to the roll axis in the radial direction and exerts the greatest rolling pressure on the tube, and this rolling pressure decreases toward the edges of the working surfaces. The specific rolling pressure is thus different, and because in the familiar designs certain surface sections of the tube bloom are rolled only by the base of the rolls and other surface sections of the tube are rolled only by the edge regions of the working surfaces, the substantial wall thickness differences mentioned above arise due to the different specific rolling pressures.

Another disadvantage of the familiar tube release roll mills consists in the fact that overrollings occur, whereby the tube blooms acquire wrinkles on their outer surfaces. Furthermore, the familiar tube release roll mills operate with relatively high r.p.m.'s due to their narrow rolls and the resulting smaller angle of inclination—thus, sharper skewing—in order to be able to achieve the required rate of advance and throughout capacity. This causes not only substantial noise, but also favors the development of defects in the rolled goods.

The invention proposes a tube release roll mill which not only detaches the tube bloom flawlessly from its mandrel rods, but also substantially avoids wall thickness nonuniformities and surface defects and also operates more quietly.

This goal is achieved according to the invention in that the identically designed rolls have a working surface width of more than 1 times, preferably 1.03–1.5 times the advance distance per revolution of the tube bloom with the largest outside diameter, that the roll pair spacing or spacings are equal to 1.5 or 2.5 or 3.5 times, etc., up to 6.5 times the advance distance per revolution of the well-nigh smallest tube bloom in outside diameter, and that the angle of attack of the rolls is between 33 and 55 degrees. The largest tube bloom is understood here to be the one with the largest outside diameter that can still be rolled on the tube reeler roll mill. Analogously, the smallest tube bloom is that with the smallest outside diameter that can still be rolled with the tube release roll mill involved. The fact that in the dimensioning of the roll pair spacing according to the invention it is not precisely the smallest tube bloom provided in the rolling program that is used as the determining value, but rather the "well-nigh" smallest tube bloom is that the tube bloom that is actually the smallest is generally only very seldom rolled and instead a somewhat larger tube bloom must be rolled considerably more frequently. In dimensioning the roll pair spacing of the tube release roll mill it is therefore more expedient not to select the actually smallest tube bloom as the basis, but the one that is indeed in the region of the smallest outside diameters, but, which is the most rolled of these in the frame of the rolling program provided.

Due to the larger working surface width selected in accordance with the invention, one achieves a substantial reduction in the difference in specific rolling pressure that unavoidably occurs between the region of the roll base and the edge zones of the roll working surfaces. This is based on the fact that with a larger working surface width of the rolls an angle of attack lying much closer to the theoretical value can be used than in the familiar construction. Due to the tolerances that the entering tube bloom has, the rolls of a tube release tube roll mill cannot be set precisely to the theoretical value, but it is necessary, in order to assure a flawless entrance of the tube bloom into the tube release roll mill, to select the angle of attack somewhat larger. However, if an angle of attack that is larger than the theoretical value is selected in order to be able to better introduce the tube bloom, the difference in the specific roll pressure between the pass base and the edges of the working surfaces is larger in a conventional short roll than in the longer roll according to the invention. In order to achieve the same introduction effect, the longer roll according to the invention requires only a smaller angle deviation from the theoretical value and thus the difference relative to specific rolling pressures also becomes smaller. The larger working surface width of the rolls also has the advantage that the danger of overrolling is less. This is due to the fact that the tube bloom is enclosed by the rolls over a larger portion of its surface and consequently the ovalness of the tube bloom cross section is not as great during the rolling process, which is the principal reason for the occurrence of overrollings.

The roll pair spacings according to the invention also help to achieve a more uniform wall thickness. Through the larger working surface width of the rolls it is indeed possible to maintain the specific rolling pressure more uniform, but it is impossible to achieve a specific rolling pressure that is everywhere identical. Consequently, a certain irregularity in the wall thickness remains in spite of the larger working surface width of the rolls according to the invention. The roll pair spacing selected according to the invention induces a further compensation of this wall thickness difference through the fact that regions of the tube bloom outer surface, which were acted upon in the pass opening of the first roll pair by the pass base with the high specific rolling pressure there, are rolled in the pass opening of the second roll pair by the edge zones of the working surfaces with the lower specific pressure prevailing there. This principal then continues in the pass openings of the subsequent roll pairs, such that an additional compensation of the wall thickness differences is achieved.

The selection of the angle of attack between 33 and 55 degrees according to the invention is higher than in the familiar designs and can even be higher due to the greater width of the roll working surfaces. With an identical rate of advance and thus identical capacity, this results in lower r.p.m.'s of the rolls and the tube blooms. The latter are thus more carefully processed; therefore, this measure also serves to improve the surface quality. Noise is also substantially reduced hereby.

In a tube release roll mill with more than two roll pairs, it is recommended to dimension the roll pair spacings in the longitudinal direction of the rolled goods differently. An even better compensation of the wall thickness differences is achieved in this manner in that care is taken that each specific site of the tube bloom surface is rolled by several different regions of the roll working surfaces and thus with different specific rolling pressures in the individual pass openings, but overall with approximately the same specific rolling pressures as compared with the adjacent sites of the tube bloom surface. In dimensioning the various roll pair spacings it is recommended to use the different outside diameters of the tube blooms as a basis. Those that will be rolled most frequently according to the rolling program are most expediently selected.

In a tube release roll mill in which the rolls are supported in bearing housings and they are arranged with their faces on the guide pilots extending vertically to the roll axes, the which are installed in an axially moveable manner in the guide sleeves of the roll mill stand, the outside diameter of the guide pilot is larger than the working surface width of the rolls according to another feature of the invention. Such a large outside diameter of the guide pilot is in turn essential for achieving a good outer surface of the tube bloom and as uniform wall thickness as possible, because a large guide pilot diameter facilitates a precise and stable guidance and support of the rolls, so that they cannot deviate under the working pressure. For the same reason it is recommended to dimension the axial guide pilot length remaining in the guide sleeve at least equal to 1.5 times the diameter of the guide pilot. It is also recommended that each guide pilot is capable of being clamped solidly in the region of the edge of its guide sleeve facing toward and away from the rolls. In a further implementation of the invention the clamping force at the edge of the guide sleeve facing the rolls should be essentially directed toward the force coming from the roll and on the edge of the guide sleeve facing away from the roll it should be directed opposite to this force. This particular type of clamping also favors a flawless and stable guidance and support of the rolls. The play required for adjustment is cancelled by the proposed measures during rolling. A deviation of the rolls is also avoided hereby and a flawless tube bloom surface and an essentially uniform wall thickness are obtained.

The invention is depicted in the drawings by means of an implementation example.

Figure 1:
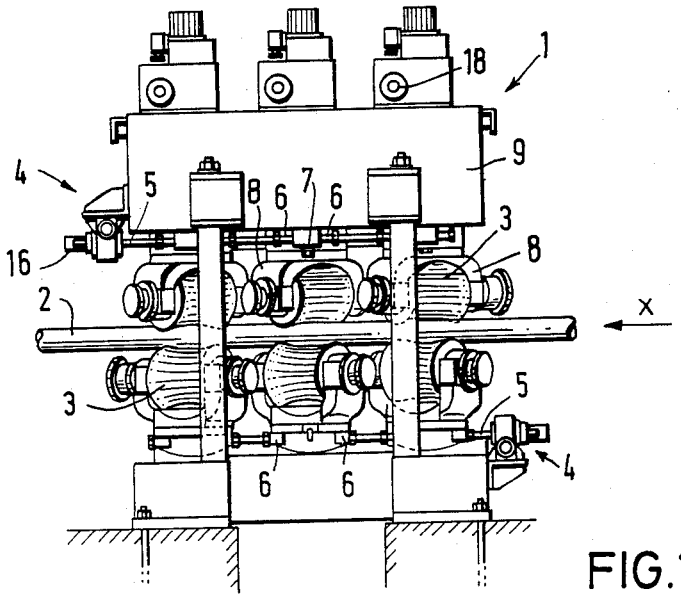
FIG. 1 shows a tube release roll mill with three roll pairs in side view.
Figure 3:
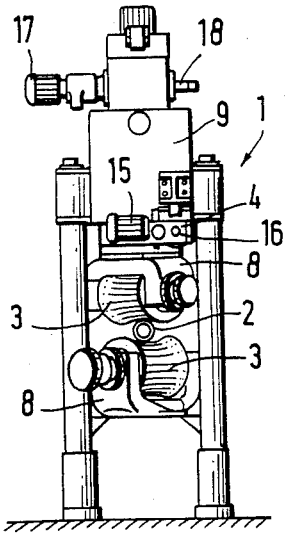
FIG. 3 shows the tube release roll mill according to FIG. 1 from the exit side.

In FIG. 1 a tube release roll mill is designated by 1, as it is located beyond a tube push bench (not shown) in order to detach the tube bloom from the mandrel rod inside of it so that the latter can be drawn out of it. Such a tube bloom is shown in FIG. 1 and designated by 2. The mandrel rod inside is not visible. The tube bloom 2 is processed here by a total of six rolls 3, which are arranged in pairs and thus form a common pass opening. The roll axes extend diagonally to the longitudinal direction of the rolled goods x, which is particularly evident in FIGS. 2 and 3. The angle of attack $\alpha$ (FIG. 2) is adjustable by means of adjusting devices 4, which are provided separately for the upper and lower rolls and are shown in FIGS. 1 and 3. An adjusting spindle 5 permits a joint swivelling of the three upper or lower rolls 3, which can be stopped in any adjustment position. Threaded bushings 6 permit a separate adjustment of the angle of attack $\alpha$ of each roll 3. An indicator 7 on the bearing housing 8 and on the stand 9 of the tube release roll mill 1 facilitates a precise adjustment of each roll 3.

Figure 2:
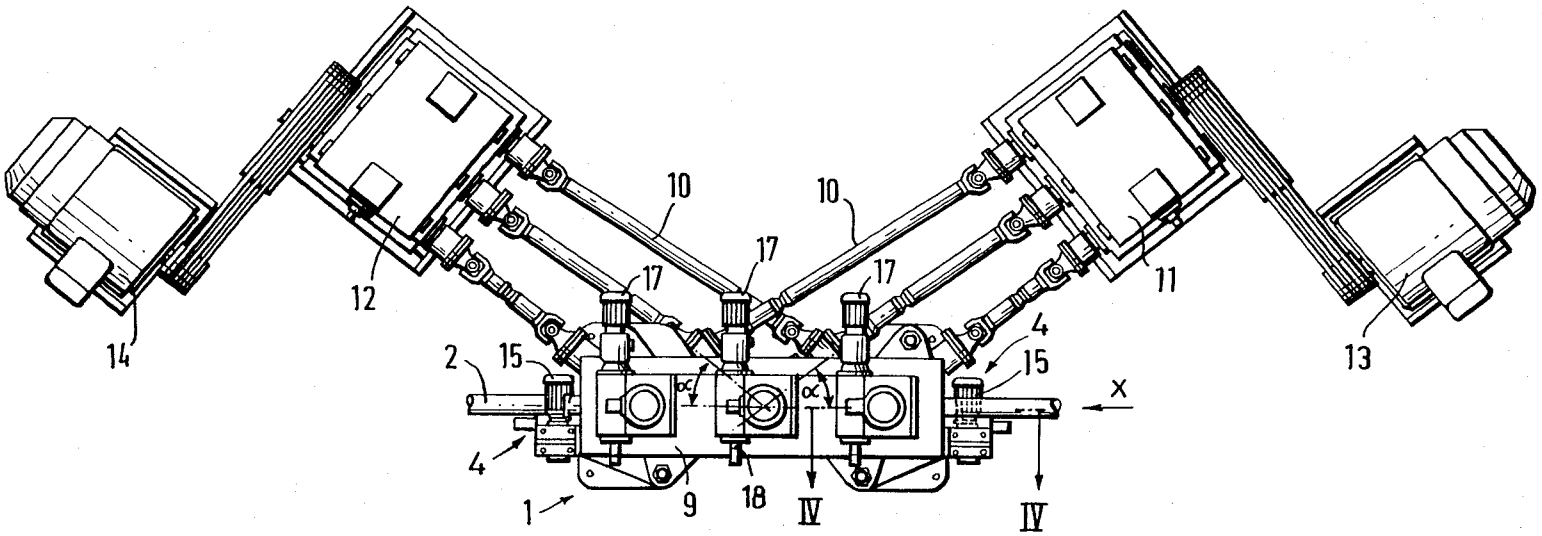
FIG. 2 shows the tube release roll mill according to FIG. 1 in top view.

All the rolls 3 are driven through their own drive shafts 10, which are shown in FIG. 2. Distributor transmissions 11 and 12, which are driven by motors 13 and 14, are provided separately for the upper and lower rolls 3.

FIGS. 2 and 3 show the servo motors 15 for adjusting the angle of attack $\alpha$ of the rolls 3. However, the adjusting spindle 5 can also be turned by hand for the fine adjustment, for which a suitable tool is placed on the lugs 16 of the adjusting spindle 5.

Figure 4:
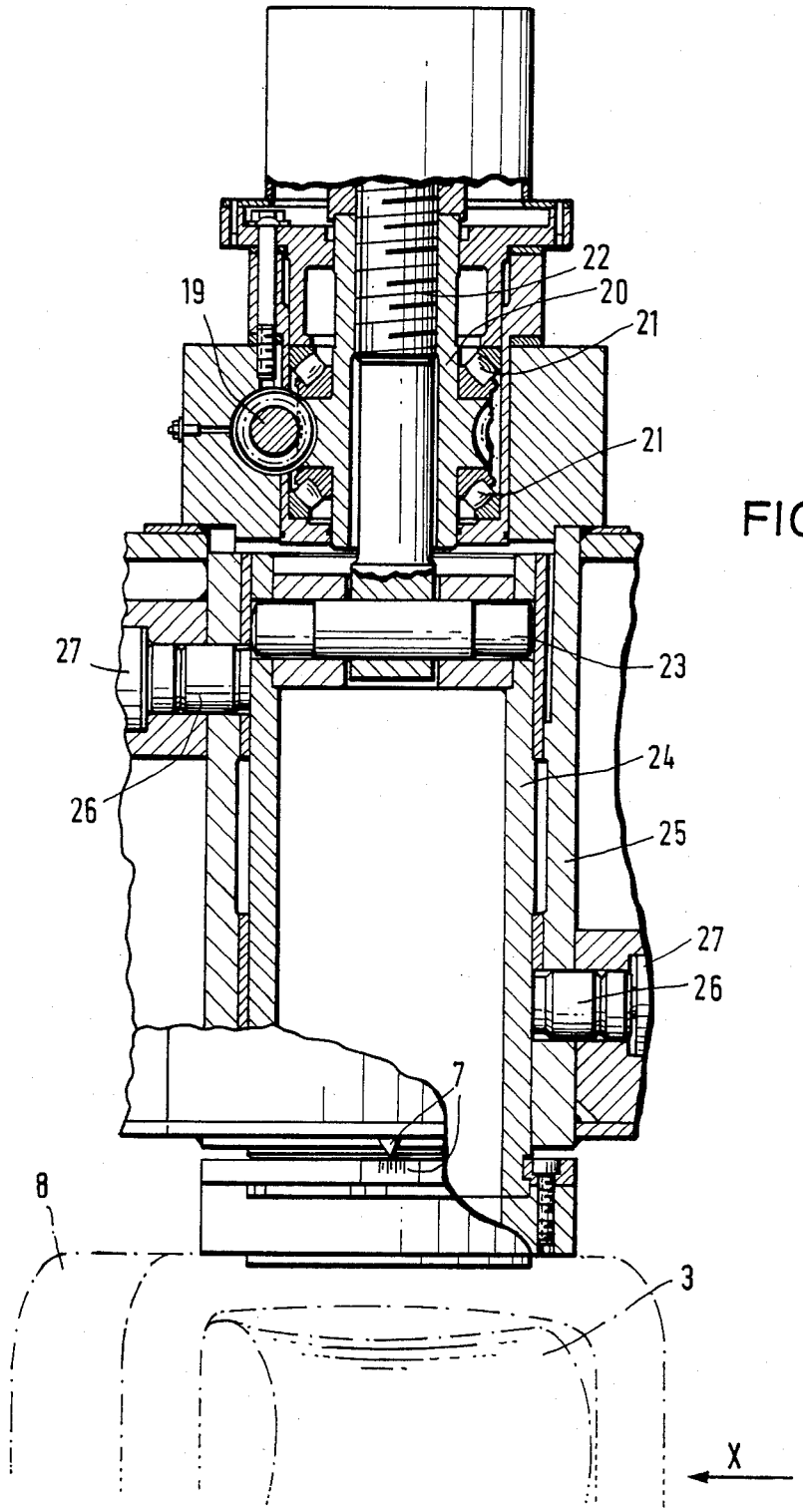
FIG. 4 shows a section along line IV—IV of FIG. 2.

The rolls 3 are also adjustable in the vertical direction radial to the tube bloom 2. This is true only for the upper rolls 3, while the lower rolls 3 are not adjustable in the radial direction. The radial adjustment movement of the upper rolls 3 takes place either with the aid of the servo motors 17 or by hand for a fine adjustment, for which a suitable tool (not shown) is placed on the lugs 18. The adjusting mechanism is clearly evident in FIG. 4. A worm shaft 19 driven by the servo motor 17 or through the lugs 18 moves a worm gear 20, which is supported in a fixed or rotatable manner in the bearings 21. A threaded spindle 22 is thus moved in the vertical direction; a guide pilot 24 of large diameter is fastened to its lower end section through a joint bolt 23. On this guide pilot 24 there is at the lower face the bearing housing 8 of one of the upper rolls 3, whereby the bearing housing 8 is rotatably fastened to the guide pilot 24.

The guide pilot 24 is carried in a guide sleeve 25 of the roll mill stand 9. After the radial position of the roll 3 is adjusted, the guide pilot 24 is clamped in the guide sleeve 25, which is effected with the aid of clamps 26, which are pressed against the wall of the guide pilot 24 with the required clamping force by a working cylinder 27 that is acted upon by pressure medium. In this manner the guide pilot 24 is stopped free of play inside the guide sleeve 25. It is clearly evident that the clamping force in the lower region of the guide sleeve 25 is in the direction of the force coming from the roll 3 and in the upper region of the guide sleeve 25 it is directed against this force.

Figure 5:
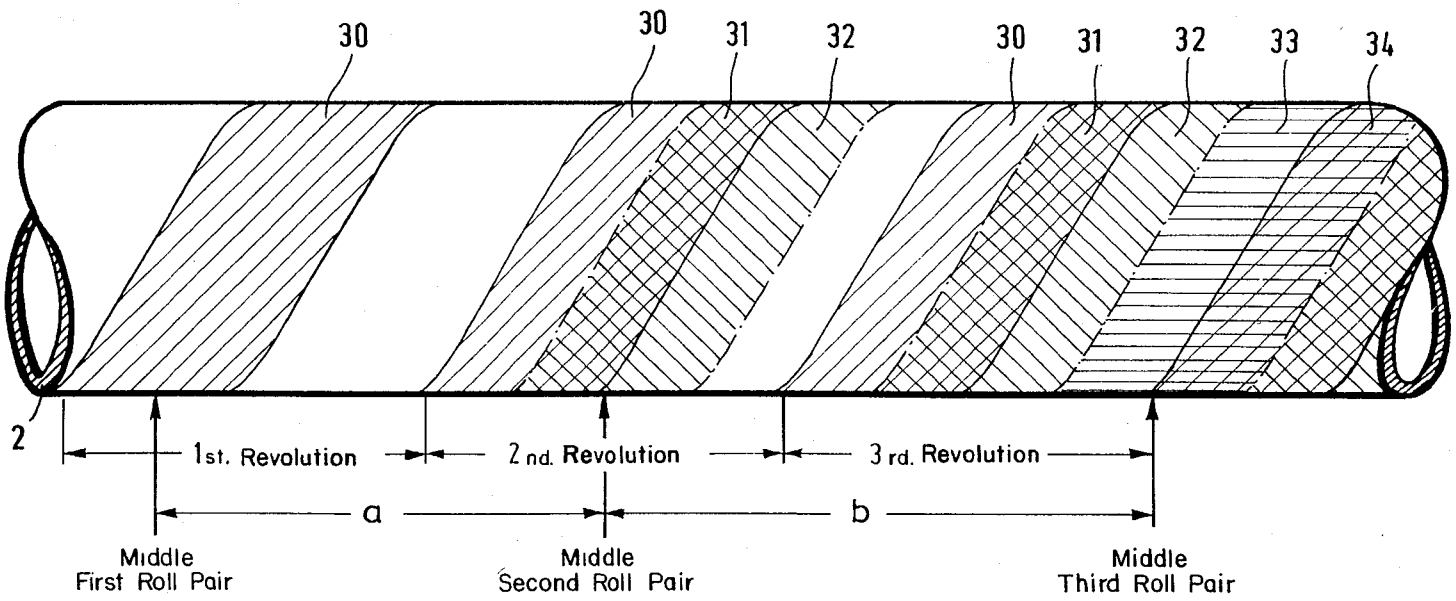
FIG. 5 shows a tube bloom section in schematic presentation.

The tube bloom 2 is shown in larger scale in FIG. 5. In order to illustrate the action of the invention design of tube release roll mill 1, the tracks of rolls 3 are drawn on the tube bloom 2 in FIG. 5. The track of the first roll pair is designated by 30 and is characterized by a hatching rising to the right. For a clearer presentation only one track of each roll pair is shown hatched. The track 30 of the first roll pair is particularly clearly evident in FIG. 5 on the left. However, it continues to the right in identical manner with each rotation of the tube bloom 2. The spacing designated by "a" between the first and the second roll pairs causes the tracks of the first and second roll pairs to overlap in the surface region 31. This overlapping takes place in the example shown such that those sections of the tube bloom surface that were rolled by the working surface edges of the first roll pair are rolled by the pass base of the second roll pair so that an equalization with respect to the degree of rolling pressure is obtained. The track 32 of the second roll pair is represented by dot-dash border lines and a hatching rising to the left. The track 33 of the third roll pair is marked with horizontal hatching lines. Because the roll pair spacing "b" between the second roll pair and the third roll pair is different and larger, this roll pair rolls the region not yet overrolled by the two previous roll pairs and also overlaps the region 34, which has already been rolled by the first roll pair, in which case an equalization of the rolling pressures is again obtained through the fact that the tube bloom surface sections that have been rolled by the left edge region of the first roll pair are now rolled by the pass base of the third roll pair. An extensive equalization of the actual rolling pressures thus also occurs here.

In the foregoing specification we have set out certain preferred practices and embodiments of our invention, however, it will be understood that this invention may be otherwise embodied within the scope of the following claims.

We claim:

1. In a tube release rolling mill having four or more driven rolls which form pass openings in pairs and rolls axes extending at an adjustable angle of attack diagonally to the longitudinal direction of tubes rolled therebetween and in which the roll axes of each roll pair run diagonally in an intersecting manner in different directions, the improvements comprising the rolls being identicallly designed and having a working surface width of more than 1 times the advance distance per revolution of a tube bloom with the largest outside diameter to be rolled therein; said roll pair spacings are dimensioned equal to one of 1.5, 2.5, 3.5, 4.5, 5.5, and 6.5 times the advance distance per revolution of the tube bloom with the smallest outside diameter to be rolled therein and said angle of attack of the rolls is between 33 and 55 degrees.

2. In a tube release rolling mill as claimed in claim 1 wherein the rolls have a working surface width of 1.03 to 1.5 times the advance distance per revolution of the tube bloom with the largest outside diameter to be rolled therein.

3. In a tube release rolling mill as claimed in claim 1 or 2.wherein the rolls have a roll pair spacing dimensioned equal to 2.5 to 6.5 times the advance distance per revolution of the tube bloom having the smallest outside diameter to be rolled therein.

4. In a tube release rolling mill according to claim 3 with more than two roll pairs, characterized in that the roll pair spacings are different in the longitudinal direction of the rolled goods.

5. In a tube release rolling mill according to claim 5, characterized in that different tube bloom outside diameters are used as the basis in dimensioning the various roll pair spacings.

6. In a tube release rolling mill according to claim 5 in which the rolls are supported in bearing housings and the latter are arranged with their faces on guide pilots extending vertically to the roll axes, which are supported in guide sleeves of the roll mill in an axially moveable manner, characterized in that the outside diameter of the guide pilot is larger than the working surface width of the rolls.

7. In a tube release rolling mill according to claim 4 in which the rolls are supported in bearing housings and the latter are arranged with their faces on guide pilots extending vertically to the roll axes, which are supported in guide sleeves of the roll mill in an axially moveable manner, characterized in that the outside diameter of the guide pilot is larger than the working surface width of the rolls.

8. In a tube release rolling mill according to claim 3 in which the rolls are supported in bearing housings and the latter are arranged with their faces on guide pilots extending vertically to the roll axes, which are supported in guide sleeves of the roll mill in an axially moveable manner, characterized in that the outside diameter of the guide pilot is larger than the working surface width of the rolls.

9. In a tube release rolling mill according to claim 1 or 2 with more than two roll pairs, characterized in that the roll pair spacings are different in the longitudinal direction of the rolled goods.

10. In a tube release rolling mill according to claim 9 in which the rolls are supported in bearing housings and the latter are arranged with their faces on guide pilots extending vertically to the roll axes, which are supported in guide sleeves of the roll mill in an axially moveable manner, characterized in that the outside diameter of the guide pilot is larger than the working surface width of the rolls.

11. In a tube release rolling mill according to claim 1 or 2, characterized in that different tube bloom outside diameters are used as the basis in dimensioning the various roll pair spacings.

12. In a tube release rolling mill according to claim 11 in which the rolls are supported in bearing housings and the latter are arranged with their faces on guide pilots extending vertically to the roll axes, which are supported in guide sleeves of the roll mill in an axially moveable manner, characterized in that the outside diameter of the guide pilot is larger than the working surface width of the rolls.

13. Tube release rolling mill according to claim 1 or 2 in which the rolls are supported in bearing housings and the latter are arranged with their faces on guide pilots extending vertically to the roll axes, which are supported in guide sleeves of the roll mill in an axially moveable manner, characterized in that the outside diameter of the guide pilot is larger than the working surface width of the rolls.

14. Tube release rolling mill according to claim 13, characterized in that the axial guide pilot length remaining in the guide sleeve is at least equal to 1.5 times the guide pilot diameter.

15. Tube release rolling mill according to claim 13, characterized in that each guide pilot is capable of being clamped solidly in the region of the edge of its guide sleeve facing and turned away from the roll.

16. Tube release rolling mill according to claim 15, characterized in that the clamping force on the edge of the guide sleeve facing the roll is directed essentially in the direction of the force coming from the roll and that on the edge facing away from the roll of the guide sleeve is directed contrary to this force.

17. Tube release rolling mill according to claim 14, characterized in that each guide pilot is capable of being clamped solidly in the region of the edge of its guide sleeve facing and turned away from the roll.

18. Tube release rolling mill according to claim 17, characterized in that the clamping force on the edge of the guide sleeve facing the roll is directed essentially in the direction of the force coming from the roll and that on the edge facing away from the roll of the guide sleeve is directed contrary to this force.

* * * * *

UNITED STATES PATENT AND TRADEMARK OFFICE

CERTIFICATE OF CORRECTION

PATENT NO. : 4,512,173

DATED : April 23, 1985

INVENTOR(S) : HANS BRAUER; HANS-DIETER GERHARDS

It is certified that error appears in the above-identified patent and that said Letters Patent is hereby corrected as shown below:

Column 6, claim 5, line 5, after the word claim, change "5" to --4--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*